US005518154A

United States Patent [19]

Vassilicos et al.

[11] Patent Number: 5,518,154

[45] Date of Patent: May 21, 1996

[54] GATE AND POUR TUBE ASSEMBLY FOR USE IN THROTTLING GATE VALVE

[75] Inventors: Achilles Vassilicos, Pitttsburgh, Pa.; Simon Rodich, Crown Point; Piotr J. Zasowski, Merrillville, both of Ind.

[73] Assignee: USX Corporation, Pittsburgh, Pa.

[21] Appl. No.: 341,091

[22] Filed: Nov. 17, 1994

[51] Int. Cl.[6] ..... B22D 41/24

[52] U.S. Cl. ..... 222/600; 266/236

[58] Field of Search ..... 266/236, 45; 222/597, 222/600, 606

[56] References Cited

U.S. PATENT DOCUMENTS

| | | | |
|---|---|---|---|
| 3,436,023 | 4/1969 | Thaimann | 239/537 |
| 3,685,707 | 8/1972 | Shapland | 222/559 |
| 3,712,518 | 1/1973 | Meier | 222/561 |
| 3,779,431 | 12/1973 | Tinnes et al. | 222/561 |
| 3,841,538 | 10/1974 | Bode | 222/561 |
| 3,866,806 | 2/1975 | Shapland | 222/504 |
| 4,199,087 | 4/1980 | Golas et al. | 222/603 |
| 4,415,103 | 11/1983 | Shapland et al. | 222/590 |
| 4,545,512 | 10/1985 | Shapland et al. | 222/600 |
| 4,966,315 | 10/1990 | Tinnes et al. | 222/600 |
| 5,052,598 | 10/1991 | King et al. | 222/600 |
| 5,062,553 | 11/1991 | King et al. | 222/600 |
| 5,062,554 | 11/1991 | Sakai et al. | 222/600 |

FOREIGN PATENT DOCUMENTS

| | | |
|---|---|---|
| 46-16271 | 10/1971 | Japan . |
| 52-30339 | 7/1977 | Japan . |
| 6-73726 | 9/1994 | Japan . |
| 7402764 | 9/1974 | Netherlands . |

*Primary Examiner*—Scott Kastler

*Attorney, Agent, or Firm*—Armstrong, Westerman, Hattori, McLeland & Naughton

[57] ABSTRACT

Undesirable deposits of precipitated alloying materials are avoided in a sliding gate valve apparatus of the type in which gates are sequentially moved to and from operative position between the pour opening of a teeming vessel and a pour tube assembly for conducting molten metal from the valve apparatus, by forming the gates with through-openings whose axes are inclined in the direction of gate movement to and from their operating position in the valve apparatus, and forming the flow passage in the tube holder of the pour tube assembly with an opening extended in the direction of gate movement. The configuration of the particular gate and pour tube holder constructions are also disclosed.

12 Claims, 6 Drawing Sheets

GATE AND POUR TUBE ASSEMBLY FOR USE IN THROTTLING GATE VALVE

BACKGROUND OF THE INVENTION

The present invention relates to the throttled teeming of molten metal from teeming vessels into a receiver, such as, for example, the mold of a continuous caster. More particularly, the present invention relates to an improved form of gate and pour tube holder for use in sliding gate valves of the throttling type.

In U.S. Pat. No. 4,415,103, issued Nov. 15, 1983 to E. P. Shapland, et al., there is described one form of sliding gate valve of the type in which refractory gates can be moved sequentially into and out of an operative position with respect to the flow opening from a metal teeming vessel, such as a tundish, and which, in such operative position, can be selectively moved in order to throttle the flow of metal from the vessel. In such valve apparatus, a top plate containing a flow passage is fixedly positioned in communication with the vessel flow opening. The valve apparatus also contains a pour tube assembly including a pour tube for conducting metal flow from the valve and into the receiver, and a pour tube holder for replaceably positioning the pour tube in operatively fixed, axially spaced relation from the top plate flow passage. The gates are operative to move transversely between the top plate and the tube holder across the metal flow stream and thereby control the flow of metal passed through the valve apparatus by varying the effective size of the flow passage by displacing the gate opening with respect to the top plate flow passage.

Problems have been experienced in the utilization of throttling gate valves, particularly in the production of aluminum-killed steels which are high quality steels whose utility is prominent where metal surface quality and drawing capability are critical. The problems are most apparent during the operation of valve apparatus of the described type, particularly under partial, or throttled flow conditions, when deposits of alumina accumulate in the gate opening tending to plug it. From examination of a typical prior art valve arrangement, such as that illustrated in FIG. 12, it can be seen that the problem of accumulation of alumina deposits is exacerbated, in substantial part, due to the partial obstruction of the gate orifice A by the exposed surface B of the tube holder C when the valve operates under throttled or partial flow conditions. Although a restriction in metal flow through the gate can sometimes be compensated by adjusting the position of the gate in order to expand the area of the flow opening, the accumulation of deposits in the gate opening results in gates rapidly becoming inoperative for their intended purpose. Consequently, gates must be changed frequently thereby resulting in an increased cost of production, represented not only by an increased cost of refractory elements for the valve, but also by increased costs attendant with disruption of the teeming operation.

It is to the amelioration of such problems, therefore, to which the present invention is directed.

SUMMARY OF THE INVENTION

According to one aspect of the invention, there is provided a combination of a molten metal teeming vessel having an outlet in its bottom wall; a top plate fixed with respect to the vessel bottom with its flow passage in communication with the vessel outlet; a pour tube assembly including a pour tube and a pour tube holder containing flow passages fixed in substantial axial alignment with the top plate flow passage, and a gate disposed intermediate the top plate and the tube holder containing a through-opening effective to establish flow communication between the flow passages of the top plate and the pour tube holder; and means for moving the gate between positions in which the gate opening registers with the top plate opening, is out of communication with the top plate opening, or at various flow throttling positions therebetween, the gate having opposed parallel surfaces for sliding contact with mating surfaces on the top plate and the pour tube holder, respectively, and the flow passage in the pour tube holder having an end communicating with the gate opening that is extended in the direction of movement of the gate between the aforementioned positions.

The through-opening of the gate is defined by a generally cylindrical bore whose axis is desirably disposed on an angle of inclination with respect to an axis perpendicular to the gate sliding surfaces. The pour tube holder, with which the gate cooperates, has a flow passage that communicates with the flow passage through the pour tube. The pour tube holder flow passage penetrates the sliding surface of the pour tube holder and defines an opening thereat which is elongated in the direction traversed by the gate in its movement across the tube holder for metal flow throttling purposes. In the transverse direction, the tube holder opening has a dimension which corresponds generally with the dimension of the bottom portion of the opening in the gate which penetrates the slide surface thereof.

According to other aspects, the invention contemplates the design and construction of gate plates and pour tube holders suitable for use in the practice of the invention.

It is, therefore, a principle object of the invention to provide a sliding gate valve organization suitable for use in the throttled teeming of molten metal from a teeming vessel into a receiver in which the refractory elements, particularly the through-opening in the gate, are less susceptible to the accumulation of undue amounts of deposits, especially alumina deposits.

It is therefore a further object of the invention to provide replaceable refractory elements, particularly gate plates and pour tube holders for use in sliding gate valves, which elements are capable of longer periods of productive utility.

For a better understanding of the invention, its operating advantages, and the specific objectives obtained by its use, reference should be made to the accompanying drawings and description which relate to a preferred embodiment thereof.

DESCRIPTION OF A PREFERRED EMBODIMENT OF THE INVENTION

Figure 1:
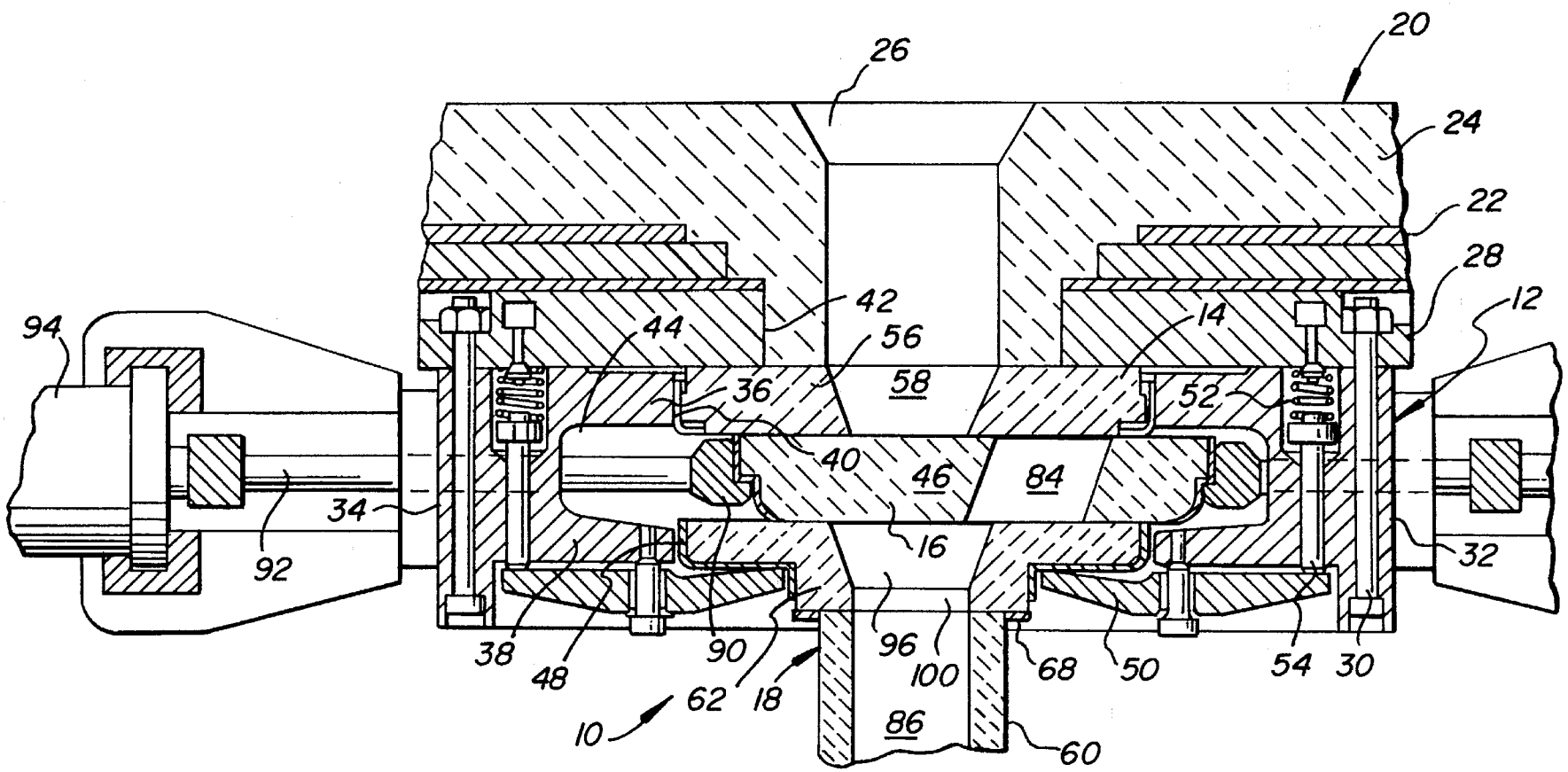
FIG. 1 is a sectional elevation view of a sliding gate valve organization incorporating the present invention.

With particular reference to FIG. 1 of the drawings, there is shown one form of sliding gate valve for teeming molten metal from a bottom pour vessel for which the present invention is adapted for use. The sliding gate valve apparatus of the type illustrated in FIG. 1 is shown and described in detail in U.S. Pat. No. 4,415,103, issued Oct. 8, 1985 to E. P. Shapland, et al., the contents of which patent are accordingly incorporated herein by reference and only so much of a description of the concerned valve structure as is particularly required for an understanding of this invention is provided herein.

The sliding gate valve organization shown in FIG. 1 is identified generally by numeral 10 and comprises a valve frame structure 12 for operative reception of replaceable refractory members including a top plate 14, a gate 16 and a pour tube assembly 18. The valve frame structure 12 is disposed below the bottom of a metal teeming vessel 20, such as a tundish adapted to be positioned above the mold of a continuous caster (not shown), or the like. The illustrated vessel 20 comprises a metal shell 22 containing a refractory lining 24 through which a generally cylindrical tap hole 26 extends to form the pour opening from the vessel.

The valve frame structure 12 is detachably connected to the bottom surface of vessel 20 by means of a mounting plate 28 that receives a plurality of threaded connectors or bolts 30. The frame structure 12 of the sliding gate valve 10 illustrated in FIG. 1 has generally rectangularly disposed opposed side walls 32 and 34, a top wall 36 and a bottom wall 38. The top wall 36 contains an opening 40 axially aligned with a similar opening 42 in the mounting plate 28 beneath the tap hole 26. The opening 40 in the top wall 36 is of rectangular shape and particularly dimensioned to fixedly receive the top plate 14. The frame structure 12 beneath the top wall opening 40 contains an elongated passage 44 extending perpendicularly to the plane of the drawing, along which passage gates 16 are adapted to be conducted between a loading section and a discharge section (neither of which is shown in the drawing) and an operating section identified generally in the drawing by reference numeral 46. As is well known, the valve apparatus 10 incorporates a fluid motor device (not shown) adjacent the gate loading section for moving gates 16 sequentially along guide structures, first into the operating section 46 and, when spent, into the discharge section by the subsequent movement of a replacement gate into the operating section 46. A second passage 48 is disposed beneath the passage 44 and is adapted to conduct pour tube assemblies 18 sequentially through the valve in a manner similar to that by which the gates 16 are moved. Sets of levers 50 pivotably mounted on opposite sides of the second passage 48 cooperate with a guide structure (not shown) to receive a pour tube assembly 18 and, through the action of springs 52 and pins 54, bias the pour tube assembly upwardly to establish seal pressure between the engaging surfaces of the respective refractory elements. When positioned in the operating section 46 of the valve frame structure 12, each pour tube assembly 18 is adapted to be stationary and have the metal flow passage 86 extending therethrough in substantial axial alignment with the flow opening 58 in top plate 14.

Figure 9C:
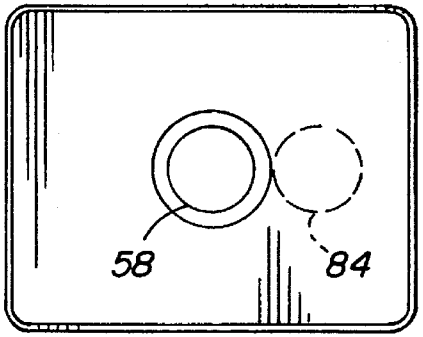
FIGS. 9(*a*), 9(*b*) and 9(*c*) are top plan views of the top plate shown in FIGS. 8(*a*), 8(*b*) and 8(*c*), respectively, illustrating the relative positions between the metal flow openings in the top plate and the gate with the gate in its fully open, intermediate or throttling and fully closed positions, respectively.
Figure 9B:
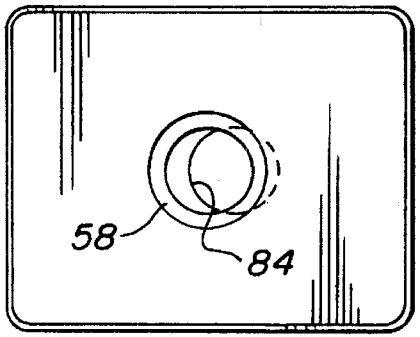

The replaceable refractory elements of the sliding gate valve apparatus 10 each essentially comprise a metal encased body of refractory material containing a through-opening for the passage of molten metal from the vessel 20. Thus, as best shown with reference to FIGS. 1 and 9, the top plate 14 comprises a substantially rectangular body 56 of refractory material having a metal casing 57 tightly enclosing its outer periphery. The body 56 contains an axially tapered through-opening 58 with a downwardly convergent wall. The upper end of the opening 58 has a diameter conforming to that of the vessel tap hole 26, with which it communicates, while the lower end of the opening is sized for registration with the through-opening 84 in the gate 16, as hereinafter more fully described.

The pour tube assembly 18 comprises a pour tube 60 which is an axially elongated, hollow cylindrical tubular element formed of refractory material and operates for conducting molten metal from the valve in a confined or shrouded manner into a caster mold. The upper end of the pour tube 60 is adapted for attachment to a tube holder 62. The illustrated tube holder 62 is essentially of conventional construction in that it comprises a rectangular body 64 of refractory material having a depending extension 66 to which the upper end of the pour tube is attached by means of a conventional connector 68. A metal casing 70 encloses the periphery and bottom of the body 64 and the external surface of the extension 66.

The bottom surface 72 of top plate 14 and the upper surface 74 of the tube holder 62 are formed as sliding surfaces for sliding engagement with the spaced upper and lower surfaces 76, 78 of the gate 16 when the gate is positioned in the operating section 46 of the valve frame structure 12. The movement, during which the concerned sliding engagement occurs, is in a direction transversely of the direction of movement of the gates 16 along the loading, operating, and discharge sections of the valve structure 12.

Figure 3:
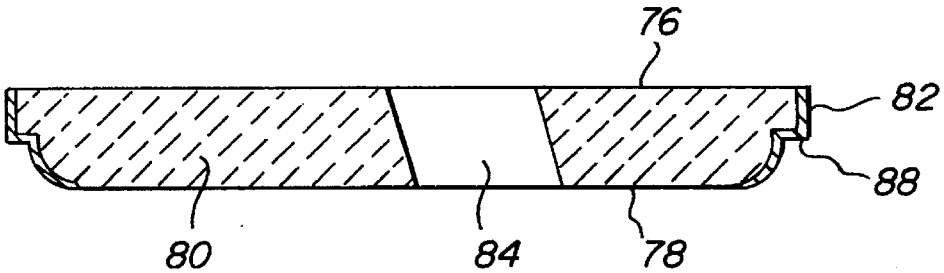
FIG. 3 is a sectional view of the gate of FIG. 2 taken along line 3—3 thereof.
Figure 2:
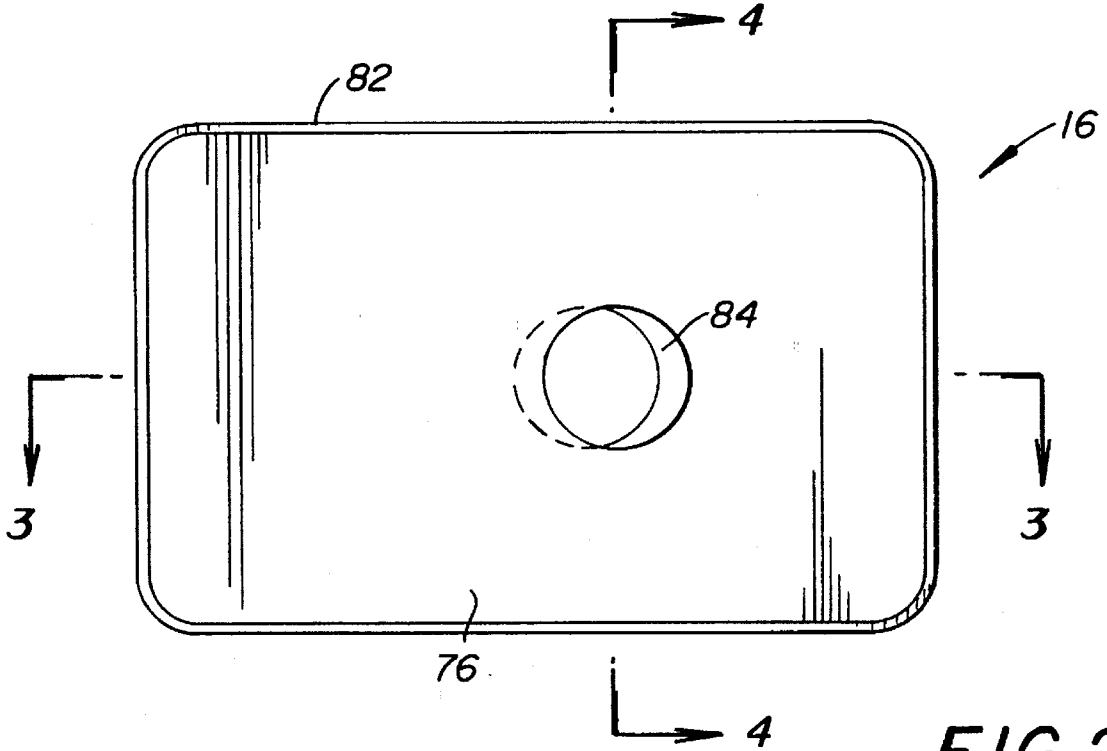
FIG. 2 is a top plan view of the gate shown in FIG. 1.
Figure 4:
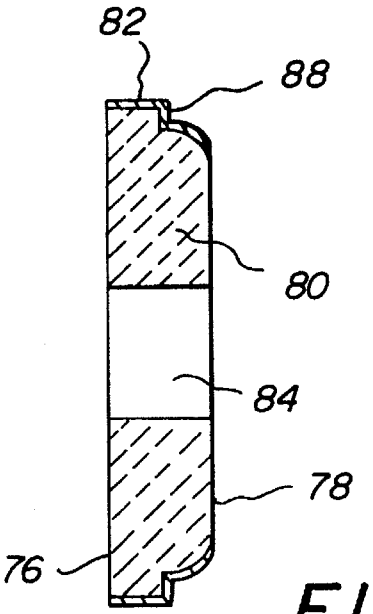
FIG. 4 is a sectional view of the gate of FIG. 2 taken along line 4—4 thereof.
Figure 5:
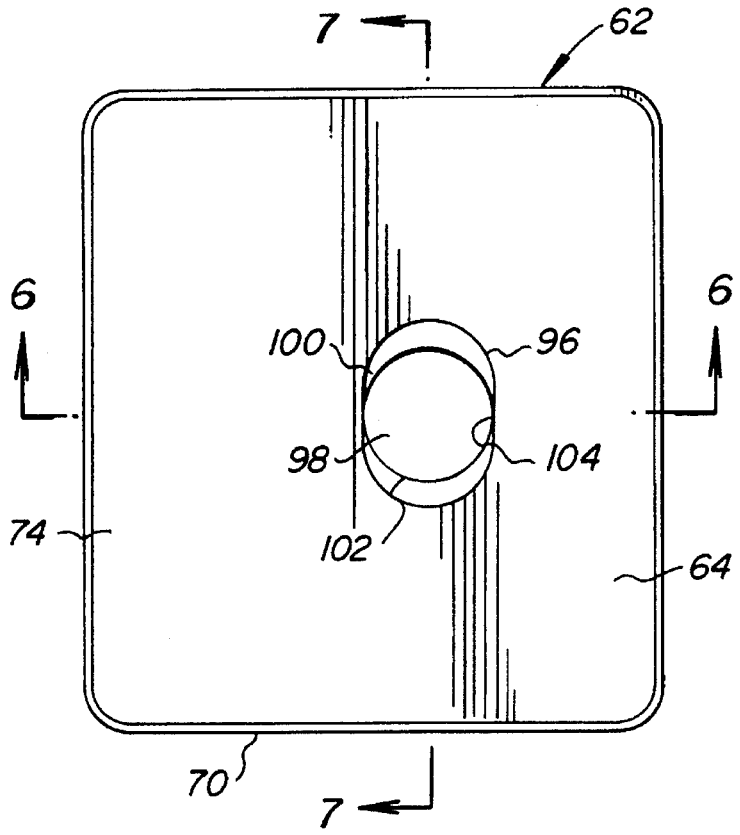
FIG. 5 is a top plan view of the pour tube holder shown in FIG. 1.

The structural configuration of the described gate 16 is essentially conventional in that it comprises, as shown best in FIGS. 2 to 4, a generally rectangular body 80 of refractory material that is tightly encircled about its periphery by a metal casing 82. The gate 16 contains an orifice or through-opening 84 which is operative to communicate at its upper end with the opening 58 in the top plate and at its lower end with an opening, indicated generally as 96, in the pour tube holder 62.

The gate 16 is provided about its underside with cutouts that define rectangularly disposed shoulders 88 by means of which the gates can be guidedly moved along guide structures through the frame passage 44. Moreover, the shoulders 88, on two opposite sides of the gate 16 enable it to be engaged when in the operating section 46 of the valve frame structure 12 by oppositely spaced throttling rails 90 which serve to move the gate in a transverse direction for flow throttling purposes. As shown in FIG. 1, the throttling rails 90 each connect via connecting rods 92 to a throttling motor 94 (only one of which is shown) attached to opposite sides of the valve frame structure 12.

Figure 6:
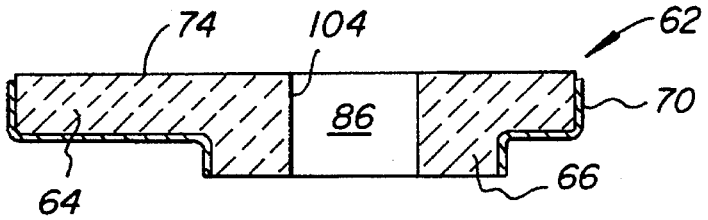
FIG. 6 is a sectional view of the pour tube holder of FIG. 5 taken along line 6—6 thereof.
Figure 7:
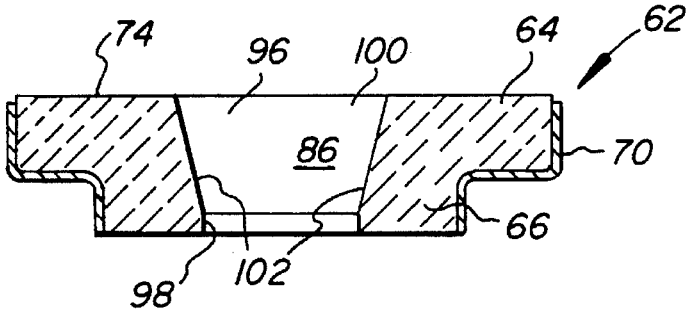
FIG. 7 is a sectional view of the pour tube holder of FIG. 5 taken along line 7—7 thereof.

According to the present invention, the structural configuration of the gate 16 and the tube holder 62 are improved in order to eliminate, or at least reduce to a minimum, the accumulation in the gate orifice 84 of alumina and other deposits which might tend to cause plugging of the orifice. Thus, the flow passage 86 through the pour tube holder 62 is particularly shaped with an opening 96 at its top or slide surface 74 which is elongated in the direction of the throttling movement of the gate 16 and has a width dimension transverse to the elongation of the opening which substantially corresponds with the diameter of the bottom portion of the gate orifice 84 that penetrates the lower surface 78 of the refractory plate body 80 of gate 16. The flow passage 86 through the pour tube holder 62 is divided into a lower portion 98 and an upper portion 100. The portion 98 which communicates with the flow passage at the upper end of the pour tube 60 is circular. Thus, the upper portion 100 of the flow passage 86 is formed as a transition section with downwardly convergent arcuate ends 102 extending between the ends of the elongated opening 96 and the circular lower portion 98 of the flow passage 86. As shown best in FIG. 6, the transverse sides 104 of the flow passage upper portion are substantially straight and spaced apart a distance corresponding generally to the diameter of the gate orifice 84.

Figure 8C:
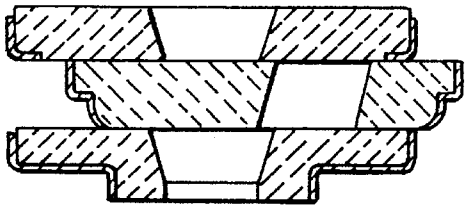
FIG. 8(*a*), 8(*b*) and 8(*c*) are generally schematic views of the top plate, gate and tube holder of the slide gate valve of FIG. 1 with the gate shown in the fully open position, the intermediate or throttling position, and the fully closed position, respectively.

Further according to the invention, the passage defining the orifice 84 through the gate body 80 is a generally cylindrical bore whose axis is inclined in the direction of throttling movement of the gate 16. The extent of inclination of the orifice 84 is such that, with its upper end displaced totally out of communication with the top plate opening 58, as when the gate 16 is moved to its fully closed position (to the right in FIG. 1) to terminate molten metal flow through the valve, the lower end of the orifice is desirably still in communication with the right hand end of the upper portion 100 of the pour tube holder flow passage 86 (see FIGS. 8*c* and 9*c*). In this way any molten metal captured in the gate orifice 84 upon closure of the valve can be discharged into the pour tube 60 via tube holder 62, thus to prevent any opportunity for the molten metal to freeze and plug the orifice.

Figure 8B:
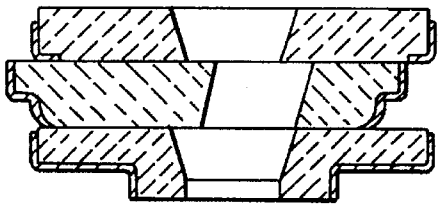
Figure 9A:
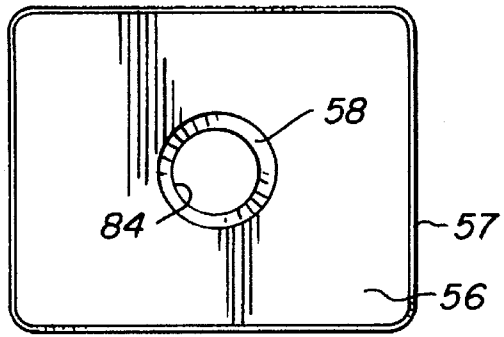
Figure 8A:
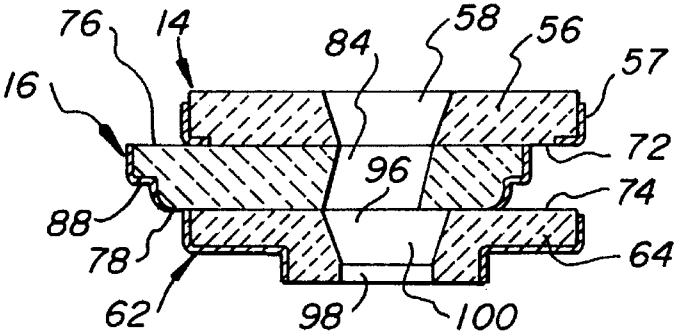

When the gate 16 is moved to its full open position, as shown in FIG. 8*a* and 9*a*, the upper end of the orifice 84 registers with the opening 58 in top plate 14 and the lower end thereof is disposed with respect to the opening 96 in the pour tube holder 62 such that there is no portion of the pour tube holder upper surface 74 exposed to the molten metal flowing in the metal flow passage. Thus, FIG. 8*a* of the drawing, in depicting the lower end of the gate orifice 84 in registry with the left hand end of the tube holder opening 96, shows the relative disposition between the gate orifice and pour tube opening that will provide the organization with its maximum degree of effectiveness.

Because, under normal operating conditions, sliding gate valves of the throttling type operate with about fifty-five to sixty-five percent of the area of the upper portion of the gate orifice 84 exposed to the flow area of the top plate opening 58 (see FIGS. 8*b* and 9*b*), desirably under these conditions the inclined end surface 102 of the tube holder flow passage portion 100 is substantially aligned with the inclined wall of the orifice 84.

It will be appreciated that the provision of refractory elements of the described configuration are effective in reducing to a minimum the tendency of blockage of the gate orifice 84 to occur as a result of accumulation of alumina and/or other particles therein. As a result of the cooperation between the inclined orifice bore 84 through the gate plate 80 and an opening 96 on the surface of the pour tube holder 62 which is elongated in the direction of movement of the gate 16 for throttling purposes, at no time does the upper surface of the tube holder present an obstruction to the flow of molten metal through the valve or, consequently, a ledge which can serve as a particle receptor and the initiator of undesirable particle accumulation.

It should be understood that various changes in the details, materials and arrangements of parts, which have been herein described and illustrated in order to explain the nature of the invention, may be made by those skilled in the art within the principle and scope of the invention as expressed in the appended claims. For example, it is contemplated that the bore defining the gate orifice 84 will be slightly elliptical in the transverse section in order to present circular openings at the respective upper and lower surfaces of the gate plate, the former thereby to communicate with a top plate opening 58 of circular section. On the other hand, however, the bore of the gate orifice 84 can be of circular shape taken perpendicular to the bore axis thereby creating openings at opposite ends of the orifice which are elliptical, whereupon the discharge opening from the top plate would be of corresponding elliptical shape in order to effect registration between the respective openings when the gate is disposed in its full open position in the valve.

Figure 10:
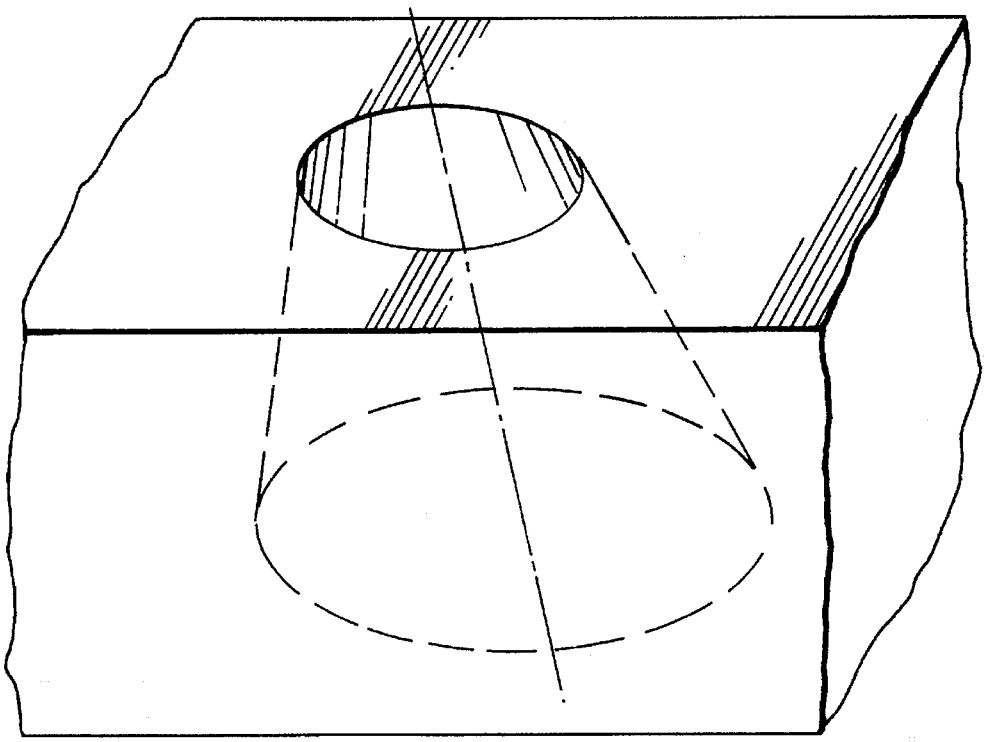
FIGS. 10 and 11 are examples of "blended surface" bores which are alternative forms of bore shapes that can be utilized in the practice of the invention.
Figure 11:
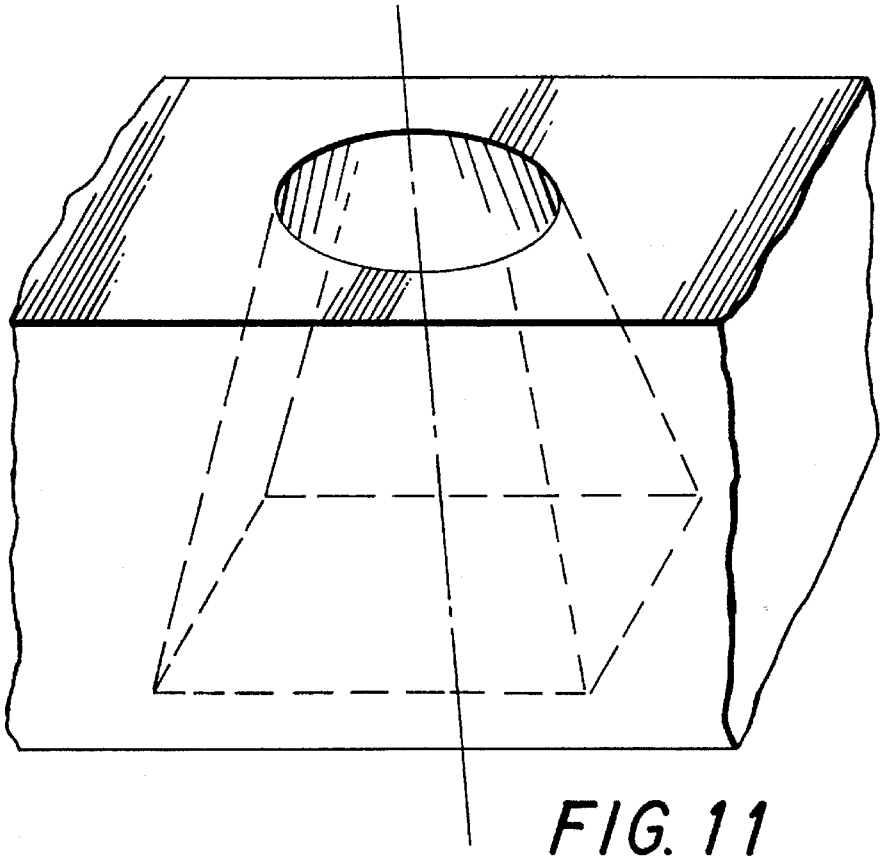
Figure 12:
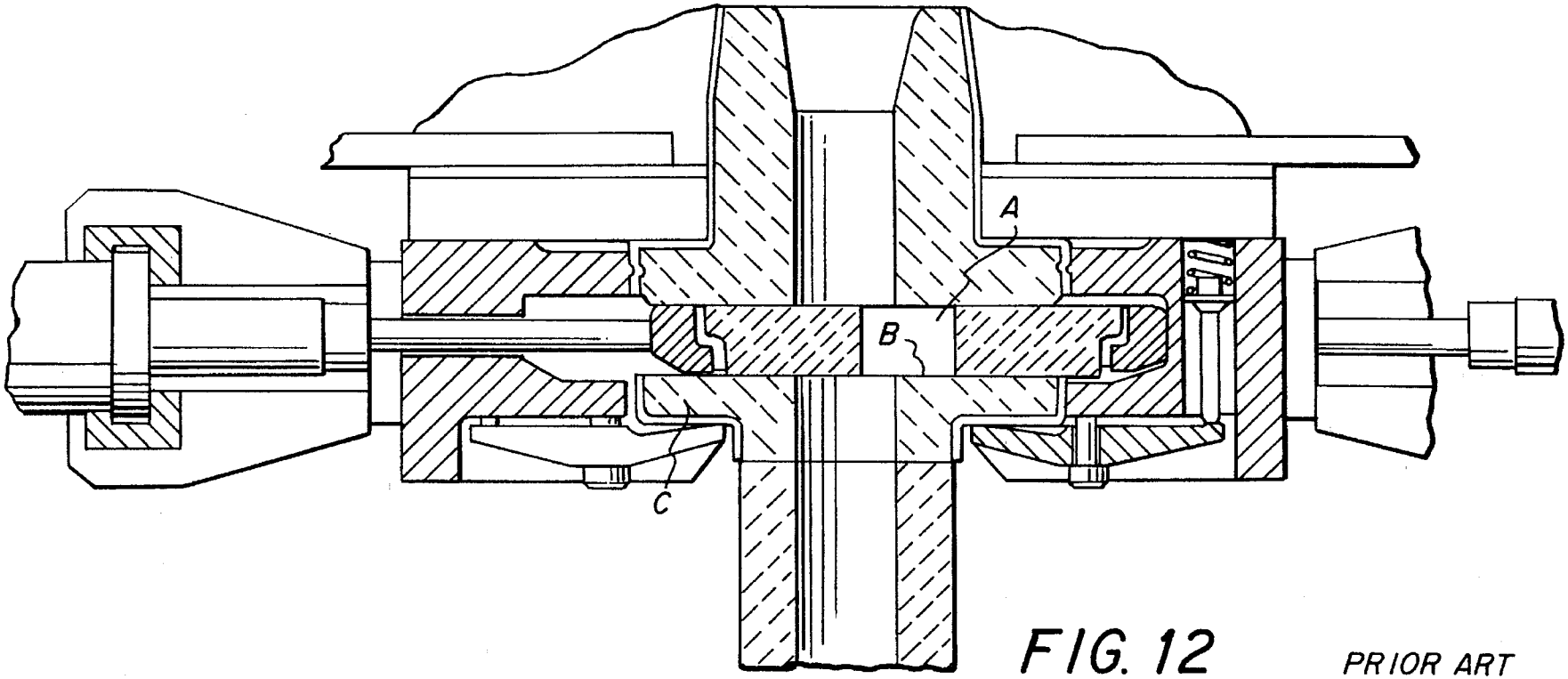
FIG. 12 PRIOR ART
FIG. 12 is a schematic representation of a top plate, gate and tube pour tube assembly of conventional prior art design shown in the throttling condition in a sliding gate valve.

Also, it is contemplated that the bore of the gate orifice 84 can be formed of a "blended surface", typical examples of which are shown in FIGS. 10 and 11. A "blended surface" bore is one in which the top end of the bore, coincident with the upper surface of the gate plate, has a first shape, while the bottom end of the plate has a second shape which is unlike the first shape. The bore wall extending between the two ends is formed of a transitional surface that may be generated by a straight line or line of curved shape.

What is claimed is:

1. The combination of a molten metal teeming vessel having an outlet in its bottom wall, a top plate fixed with respect to the vessel bottom with a flow passage in flow communication with said vessel outlet, a pour tube assembly including a pour tube and a pour tube holder containing a flow passage fixed in substantial axial alignment with said top plate flow passage, and a gate disposed intermediate said top plate and said tube holder containing a through-opening effective to establish flow communication between the flow passages of said top plate and said pour tube holder, and means for moving said gate plate between positions in which said gate opening registers with said top plate flow passage, is out of communication with said top plate flow passage, or is at various flow throttling positions therebetween, said gate having opposed parallel surfaces for sliding contact with mating surfaces on said top plate and said pour tube holder, respectively, and said through-opening in said gate extending between said opposed parallel surfaces along an axis inclined in the direction of movement of said gate between said positions, and said flow passage in said pour tube holder having an end communicating with said gate opening that is extended in the direction of movement of the gate between said positions.

2. The combination according to claim 1 in which said flow passage in said pour tube holder has an opening at the surface thereof whose axis parallel to said surface is elongated in the direction of movement of said gate plate.

3. The combination according to claim 2 in which said pour tube holder flow passage opening is of sufficient extent along said axis to communicate with said gate opening when said gate opening is out of communication with said top plate orifice.

4. The combination according to claim 2 in which said pour tube holder flow passage opening is not substantially greater in length in a direction perpendicular to said elongated axis than the diameter of said gate plate opening.

5. The combination according to claim 4 in which said pour tube holder flow passage adjacent said opening in said surface contains end faces convergent in the direction of flow through said flow passage.

6. The combination according to claim 5 in which said pour tube holder flow passage contains a substantially circular opening intermediate its length of a diameter corresponding substantially to the diameter of said gate plate opening, and said convergent end faces diverge between said circular opening and said elongated opening in said pour tube holder surface.

7. The combination according to claim 1 in which said gate through-opening has an angle of inclination of about fourteen degrees.

8. The combination according to claim 1 in which said gate through-opening is defined by a substantially cylindrical bore extending between the surfaces of said gate.

9. The combination according to claim 1 in which said gate through-opening is defined by a substantially elliptical bore extending between the surfaces of said gate.

10. A gate for disposition in valve apparatus for controlling the flow of molten metal from a vessel in which said gate is adjustably movable for flow throttling purposes intermediate the flow passages of a top plate and a pour tube holder fixedly positioned with respect to said valve apparatus, said gate comprising:

a generally rectangular refractory body having oppositely spaced sliding surfaces for engagement with mating surfaces on said top plate and said pour tube holder, respectively;

a through-opening extending through said body with the openings in the sliding surfaces thereof being selectively communicable with said flow passages in said top plate and said tube holder; and said through-opening in said body being defined by a bore extending through said body between said sliding surfaces along an axis inclined in the direction of flow throttling movement of said gate.

11. A gate according to claim 10 in which said axis of said through-opening is inclined about fourteen degrees.

12. A gate according to claim 10 including a metal casing encircling the periphery of said plate.

* * * * *